United States Patent [19]

Lockard

[11] 4,168,404

[45] Sep. 18, 1979

[54] IMPEDANCE PROGRAMMING DIP SWITCH ASSEMBLY

[75] Inventor: Joseph L. Lockard, Harrisburg, Pa.

[73] Assignee: AMP Incorporated, Harrisburg, Pa.

[21] Appl. No.: 902,479

[22] Filed: May 3, 1978

Related U.S. Application Data

[63] Continuation of Ser. No. 742,481, Nov. 17, 1976, abandoned, which is a continuation of Ser. No. 668,993, Mar. 22, 1976, abandoned.

[51] Int. Cl.[2] ..... H01H 9/00

[52] U.S. Cl. ..... 200/1 R; 200/16 D; 200/237; 323/63; 361/421

[58] Field of Search ..... 200/1 R, 6 R, 6 B, 6 BA, 200/6 BB, 6 C, 16 C, 16 D, 76, 237, 238; 338/92, 194, 252, 253, 200, 215; 323/63, 74, 80; 361/401, 404, 421

[56] References Cited

U.S. PATENT DOCUMENTS

| | | | |
|---|---|---|---|
| 3,105,729 | 10/1963 | Rosenthal | 174/68.5 |
| 3,529,212 | 9/1970 | Ballard | 361/401 |
| 3,772,486 | 11/1973 | Wiltenchik | 200/16 C |
| 3,965,319 | 6/1976 | Lockard | 200/6 B X |
| 3,974,347 | 8/1976 | Lockard | 200/6 C X |
| 4,012,608 | 3/1977 | Lockard | 200/76 X |

FOREIGN PATENT DOCUMENTS

| | | | |
|---|---|---|---|
| 1418474 | 12/1975 | United Kingdom | 200/16 C |

OTHER PUBLICATIONS

Robinson, Thomas L.; Electronics, Production Techniques–Transfer Process Avoids P.C. Open Circuits, 1-18-63, pp. 68, 70.

*Primary Examiner*—James R. Scott
*Attorney, Agent, or Firm*—Gerald K. Kita

[57] ABSTRACT

The invention relates to an assembly of miniature switches and impedances selectively pluggable into a DIP allowing impedance programming directly on a printed circuit board to which the DIP is mounted.

4 Claims, 8 Drawing Figures

IMPEDANCE PROGRAMMING DIP SWITCH ASSEMBLY

This is a continuation of U.S. Patent application Ser. No. 742,481, filed Nov. 17, 1976, and now abandoned, which, in turn, is a continuation of U.S. patent application Ser. No. 668,993, filed Mar. 22, 1976, and now abandoned.

BACKGROUND OF THE PRIOR ART

There has been a need in the communications field to provide sections of communication lines with means for impedance matching to compensate for factors which perpetrate signal dissipation or distortion. Also there is a need for a device which provides impedance matching of electronic equipment with a particular selected impedance of an already operative communication system. The trend in design of any impedance matching device has been toward reducing cost, size, weight and the number of component parts, in short, to achieve miniaturization and thereby receive all the concomitant advantages of miniaturization.

BRIEF DESCRIPTION

The present invention contributes to miniaturization of an impedance device or impedance network by providing an assembly of miniature switches and impedance components within a dual-in-line package (DIP), thereby allowing for impedance selection directly on a printed circuit board to which the DIP is mounted. The present invention is useful in the communication field or any other field wherein component selection or impedance selection on a printed circuit board is desirable. The invention achieves miniaturization by incorporating both switches and miniature electrical components or impedances in a DIP. Additionally, the invention provides formed metal strip contacts and switch poles some of which include externally connectable terminals for plugging the DIP into a printed circuit board. The strip contacts and switch poles are integrally interconnected within the confines of the DIP to allow switch programming of several impedances in various series or parallel combinations, all within the DIP. The strip contacts are disposed in readily accessible cavities in the DIP to allow any selected component or impedance to be pluggably connected within the corresponding cavity of the DIP. The components or impedances are removably in friction retention between selected contacts or are permanently electrically joined to the contacts as desired.

OBJECTS

It is an object of the present invention to provide an assembly of miniature switches and electrical components or impedances within a DIP.

Another object of the present invention is to provide a DIP with miniature switches and impedances interconnected by strip form switch poles and electrical contacts so constructed and arranged to allow switch programming of several impedances in various series or parallel combinations.

Another object of the present invention is to provide a DIP with an assembly of miniature switches and electrical contacts, the contacts being contained within readily accessible cavities of the DIP into which selected impedances are pluggably received thereby providing both impedance selection and programming of the selected impedances in various series or parallel combinations.

Other objects and many attendant advantages of the present invention will become apparent from the following detailed description taken in conjunction with the accompanying drawings.

DETAILED DESCRIPTION

Figure 1:
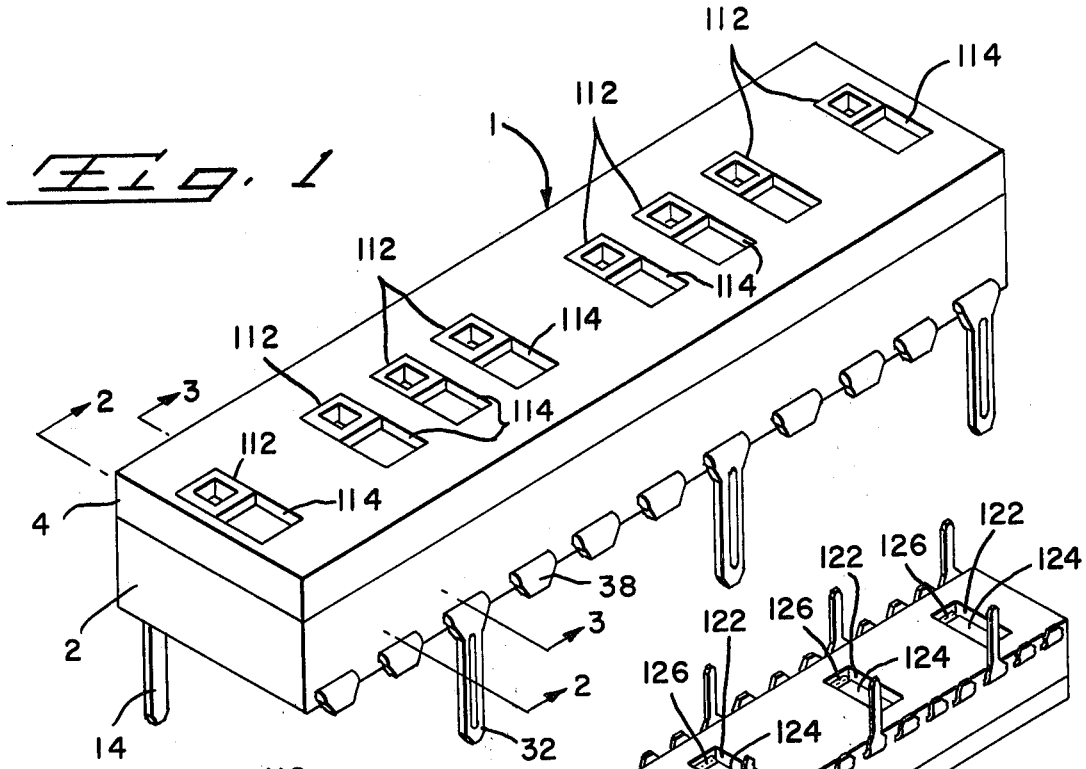
FIG. 1 is an enlarged perspective of a preferred embodiment of the present invention.
Figure 4:
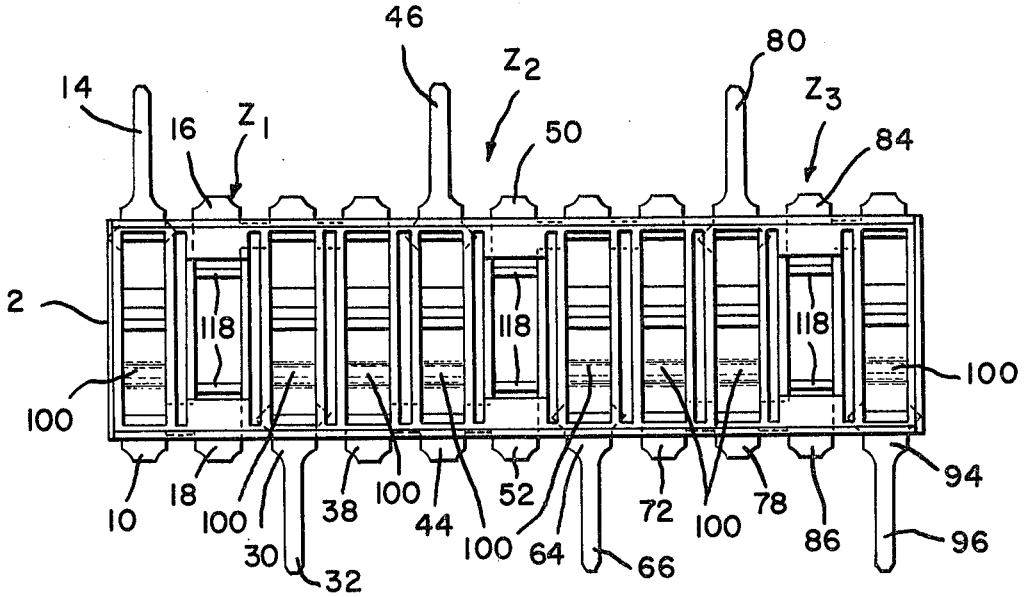
FIG. 4 is an enlarged plan view in section of the device shown in FIG. 1.
Figure 5:
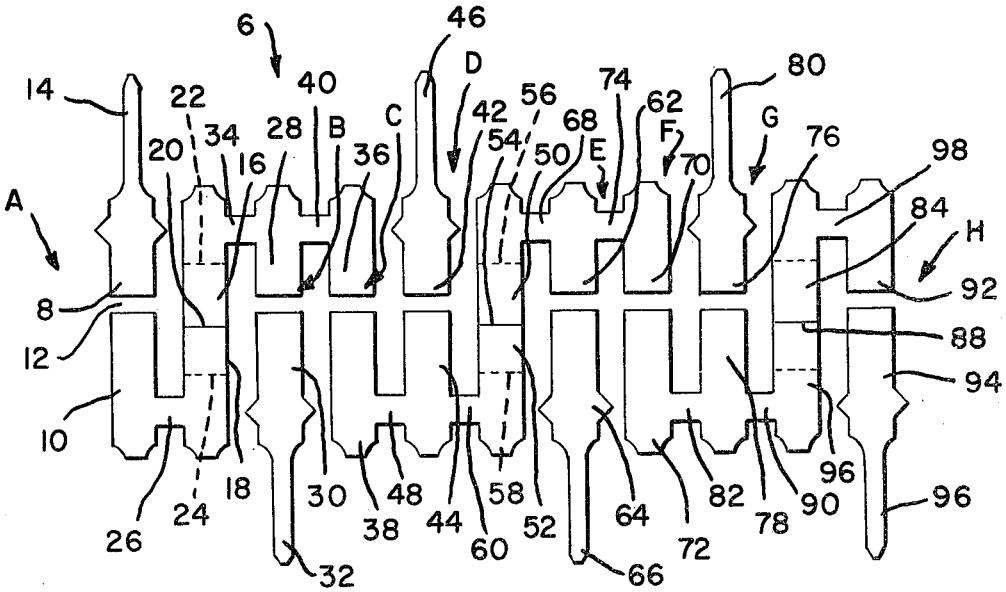
FIG. 5 is an enlarged plan view of metal strip electrical switch poles and electrical contacts prior to formation thereof into the configurations illustrated in FIG. 4.
Figure 6:
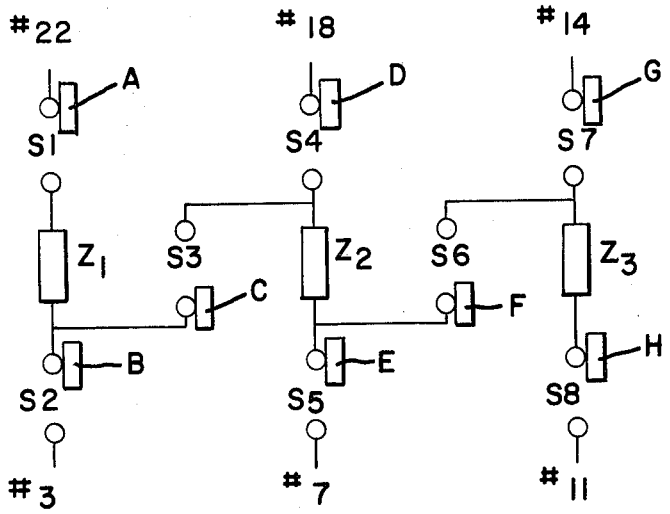
FIG. 6 is a schematic of the electrical equivalent of the present invention.

With more particular reference to FIG. 1 of the drawings there is shown generally at 1 a preferred embodiment of a dual-in-line package (DIP) incorporating a combination of miniature switches and electrical components or impedances. The package includes a molded dielectric base 2 and a separately molded dielectric cover 4 which is assembled to the base 2 and joined thereto by ultrasonic welding or by fusion or by adhesives according to any existing practice in the prior art. Turning now to FIG. 5, there is shown generally at 6 a metal strip which is stamped to the configuration shown. The metal strip will be in several separate pieces. However the separate pieces arranged as shown in FIG. 5 are then molded directly into place incorporated into the dielectric base portion 2 as shown in FIG. 4. Such a molding operation can be accomplished by any of a number of injection molding processes known in the prior art.

The metal strip shown in FIG. 5 comprises, from left to right, a pair of switch poles 8 and 10 separated from each other by a gap 12, forming part of a first switch A. The switch pole 8 has an integral elongated portion 14 which forms an electrical terminal which projects outwardly of the base 2 and which may be bent subsequently as shown in FIG. 1 to depend from the base 2 to provide an electrical terminal for plugging the DIP 1 into a printed circuit board (not shown). Again now in FIG. 5 there is shown at 16 and 18 a pair of electrical contacts separated from each other by a parting line 20. Contacts 18 and 16 are adapted to be bent at right angles (into L configurations) along dotted imaginary lines 22 and 24 respectively. The switch pole 10 of the switch A is internally joined by a metal strip portion 26 to the contact 18. A second switch B is formed with metal strip switch poles 28 and 30 separated from each other. The pole 30 is provided with an integral projecting electrical terminal 32 which forms another electrical terminal for the DIP similar to the terminal 14 as shown in FIG. 1. The switch pole 28 is integrally joined by a metal strip portion 34 to the contact 16. Another switch C is shown in FIG. 5 and includes metal strip, spaced switch poles 36 and 38. The switch pole 36 is integrally joined to the switch pole 28 by a metal strip portion 40.

Another switch is illustrated in FIG. 5 at D and comprises a pair of spaced metal strip switch poles 42 and 44. The switch pole 42 is provided with an integral elongated projecting electrical terminal 46 similar to each of the terminals 14 and 32. The switch pole 44 is integrally joined to the switch pole 38 by a metal strip portion 48. Adjacent the switch D the metal strip 6 is provided with a pair of metal strip electrical contacts 50 and 52 separated from each other by a parting line 54 and adapted to be bent into L configurations along the imaginary dotted lines 56 and 58, similarly as the contacts 16 and 18. The contact 52 is integrally joined by a metal strip portion 60 to the switch pole 44. An adjacent switch E is formed by a pair of metal strip, spaced electrical switch poles 62 and 64 similar to the switch poles 28 and 32. The switch pole 64 includes an integral terminal 66 similar to the electrical terminals 14, 32 and 46. The switch pole 62 is integrally joined by a metal strip portion 68 to the electrical contact 50. An adjacent switch F is also formed from a pair of spaced metal strip contacts 70 and 72. The contact 70 is joined integrally by a metal strip portion 74 to the switch pole 62. An adjacent switch G is formed by a pair of spaced metal strip electrical switch poles 76 and 78 similar to the switch poles 8 and 10. The switch pole 76 includes an integral projecting elongated electrical terminal portion 80 similar to the electrical terminal 14. The switch pole portion 78 is joined by an integral metal strip portion 82 to the switch pole 72. An adjacent pair of metal strip electrical contacts 84 and 86 are separated by a parting line 88 and are bent similarly as the contacts 16 and 18. The contact 86 is joined integrally with the switch pole 78 by an integral metal strip portion 90. Another switch H is formed by a pair of spaced metal strip electrical switch poles 92 and 94 similar to the switch poles 28 and 30. The switch pole 94 includes a projecting elongated integral electrical terminal portion 96 similar to the terminal portion 32. The switch pole 92 is provided with an integral metal strip portion 98 which integrally joins the switch pole 92 and the electrical contact 84.

Figure 2:
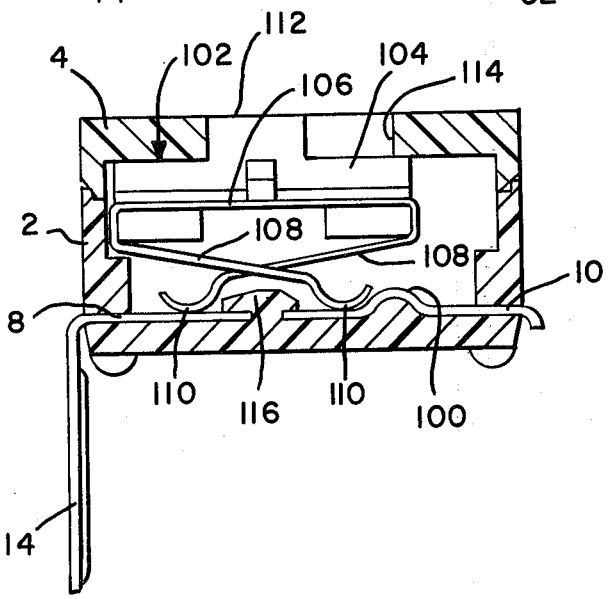
FIG. 2 is an enlarged section taken along the lines 2—2 of FIG. 1.

As shown in FIGS. 1, 2 and 4, each of the switch poles 10, 30, 38, 44, 64, 72, 78 and 94 are formed with arcuate raised portions 100. As shown in FIG. 2, with regard to the switch poles 8 and 10, and also applying in respect to each other pair of switch poles, a switch carriage 102 is provided. The switch carriage 102 is formed with a dielectric body 104 which carries a metal strip switch contact 106 having integral depending and diagonally projecting spring legs 108. The free ends 110 of the spring legs electrically engage corresponding switch poles 8 and 10 when the carriage 102 is at the extreme left portion of FIG. 2. The switch thereby is in a closed position allowing an electrical circuit to be completed from the switch pole 8 through the spring legs 108 to the switch pole 10. The carriage 102 is further provided with a generally square knob 112 which is integral with the body portion 104 and projects through a corresponding slot 114 in the cover 104. Thus as shown in FIG. 1 all of the corresponding knobs 112 of corresponding switches are at one end of corresponding slots 114 when the switches are in their closed positions; a particular closed position shown by the exemplary switch in FIG. 2.

The arcuate portion 100 provides a retention stop against which the arcuate free end 110 registers when the switch carriage is in its extreme left position as shown in FIG. 2.

To manually move the switch to an open position, the carriage is shifted manually from left to right in FIG. 2 with the knob 112 thereby shifting from the extreme left to the extreme right portion of the slot 114. The free end 110 of a corresponding spring leg 108 will be forcibly urged to slidably ride over the projection 100 of the contact 10. The other arcuate free end 110 will be urged to slidably move off of the contact 8 and will slidably ride up and register upon a dielectric projection 116 formed integrally with the base 2 to keep the contact free end 110 disengaged from the switch pole 8 thereby providing an open circuit condition when the switch is in its open position. Thus each switch can be selectively moved to an open position in a manner similar to that described. Any other type of switch means can be substituted for the particular carriage shown.

Figure 3:
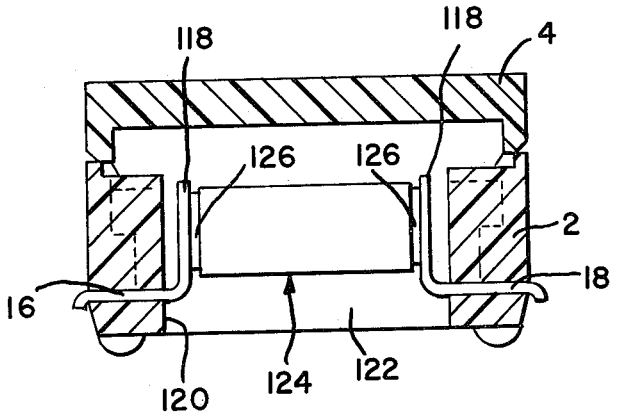
FIG. 3 is an enlarged section taken along the lines 3—3 of FIG. 1.

With more particular reference to FIGS. 3, 4 and 5, the details of the contact portions of the switch will be described in detail. FIG. 3 illustrates the exemplary contacts 16 and 18 which are bent into L-shaped configurations to provide oppositely facing metal strip portions 118. Thus as shown in FIG. 4 the contacts 16, 18, 50, 52, 84 and 86 are similarly bent to provide oppositely facing metal strip portions 118 of the contacts.

Figure 8:
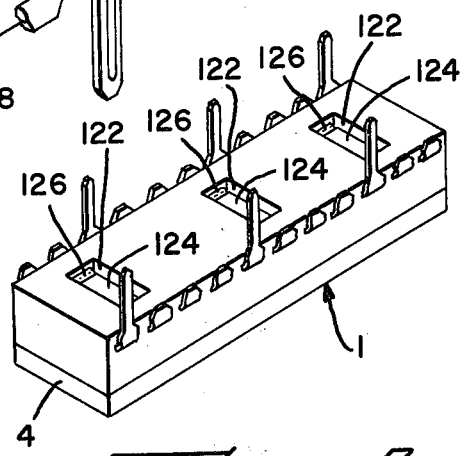
FIG. 8 is a perspective of the bottom of the embodiment shown in FIG. 1.

Additionally as shown in FIGS. 3 and 8 the base 2 of the DIP package 1 is integrally molded with a plurality of rectangular recesses or cavities 120 exposing corresponding pairs of the metal strip portions 118 therein. Dielectric sidewalls 122 are molded into the base 2 to completely enclose the cavities in dielectric and to electrically isolate the exposed contact portion 118 with dielectric. As shown in FIG. 3 an electrical circuit component 124 is frictionally received between the spaced portions 118 of the contacts 16 and 18. The conducting surfaces 126 of the exemplary electrical component 124 is thereby electrically engaged and frictionally retained against corresponding portions 118. The component 124 may be a resistor, capacitor, inductor or any other type of electrical circuit component or electrical impedance, selected and pluggably received in a corresponding recess or cavity 120 of the base 2 for electrical connection between corresponding pairs of contact portions 118. The electrical component configuration may be of any type or configuration other than that specifically shown at 124. The electrical component selected may also be permanently electrically joined to the contact portions 118 by any suitable technique such as soldering or lead bonding if frictional retention is deemed inappropriate for the type and the configuration of the selected component. The selected component may also be removed by a suitable desoldering process or merely disengaged from frictional retention between the contact portions 118, as the case may be. In addition the recesses or cavities 120 may be filled subsequent to receipt of the component 124 with a solidified potting material such as epoxy to sealably enclose and retain a selected component 124 therein.

As shown in FIG. 5, three pairs of electrical contacts are illustrated and described. Additional pairs may be added to the assembly, or pairs may be subtracted therefrom, provided the following observations are complied with. Each pair of contacts must be provided with a corresponding pair of switches. For example, the contacts 16 and 18 must have the adjacent corresponding switches A and B associated therewith. In similar fashion the second pair of contacts 50 and 52 must have the switches D and E associated therewith. Each group of contacts and associated pairs of switches can be added or subtracted from the embodiment shown in FIG. 5, provided that an additional switch is added to the assembly. For example, when adding the contacts 50 and 52 together with its adjacent switches D and E, the switch C must be added to the assembly as shown. When adding the contacts 84 and 86 together with its adjacent switches G and H the additional switch F must be provided in the assembly as shown.

FIG. 4 illustrates that the switch contacts 16 and 18 provide for receipt of a first impedance $Z_1$. The contacts 50 and 52 provide for receipt of a second electrical component or impedance $Z_2$. The switch contacts 84 and 86 provide for receipt of a third impedance $Z_3$.

Figure 7:
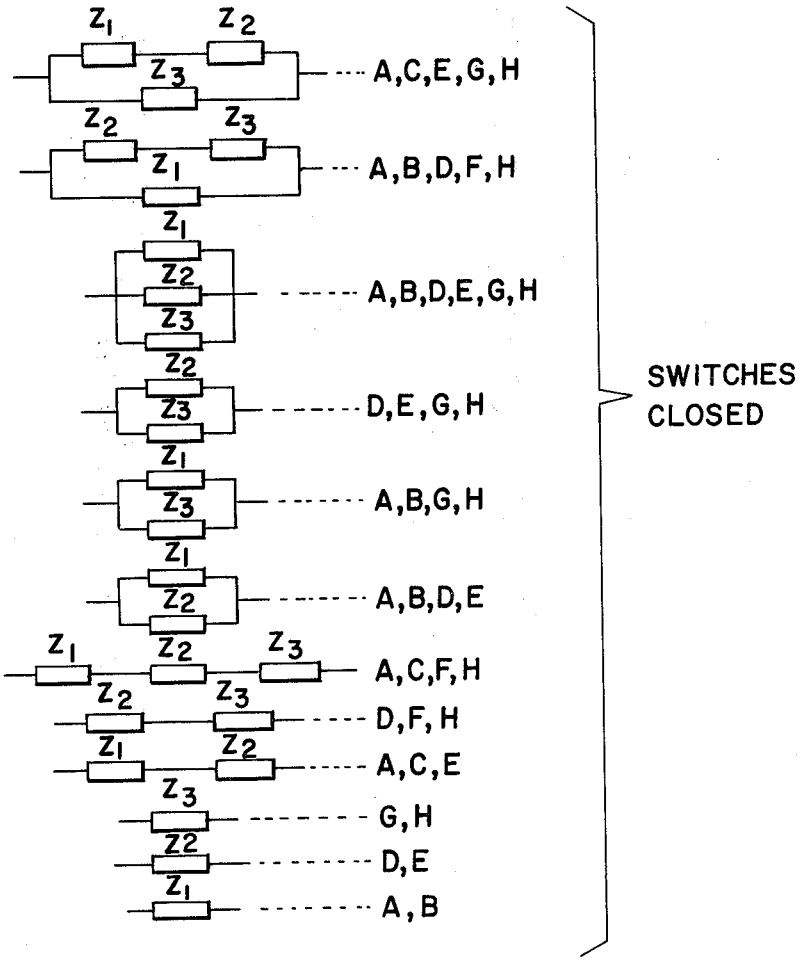
FIG. 7 is a diagram of the various combinations of series and parallel interconnections of the electrical components or impedances within the DIP according to the present invention.

FIG. 7 illustrates on the left side the electrical equivalent circuits obtained by the switches listed on the right side which are to be in their closed positions.

Although a preferred embodiment of the present invention has been described and shown in detail other embodiments and modifications thereof which would be obvious to one having ordinary skill in the art are inteneded to be covered by the spirit and scope of the appended claims.

What is claimed is:

1. A DIP arrangement of strip formed switch poles and strip formed electrical contacts for circuit impedance components which allow programming of the components directly within the DIP, comprising:

a metal strip pair of first electrical contacts in spaced relationship within a first cavity of a housing of dielectric material, first and second pairs of metal strip switch poles located in the housing, a first switch pole of each first and second pairs of poles being integral with a corresponding one of said first electrical contacts, a second pole of each first and second pairs of switch poles having an integral electrical terminal projecting outwardly of said housing for pluggable connection externally of said housing, a pair of second electrical contacts of metal strip within a second cavity of said housing, said first and second cavities adapted for pluggable receipt of electrical impedance components therein for electrical connection between corresponding pairs of said contacts, third and fourth and fifth pairs of metal strip switch poles, one switch pole of said third pair being connected with a first switch pole of said second pair of switch poles, the other switch pole of said third pair being connected with a first switch pole of said fourth pair, a first switch pole of each fourth and fifth pairs of poles being integral with a corresponding one of said second electrical contacts, a second switch pole of each fourth and fifth pairs of switch poles having an integral electrical terminal projecting outwardly of said housing for connection externally of said housing, each of said first and said second and said third and said fourth and said fifth pairs of switch poles having a corresponding manually operative switching means mounted at least partially within said housing and operatively making a disengageable electrical connection between corresponding first and second poles of said pairs of switch poles.

2. The structure as recited in claim 1, wherein, each of said cavities are accessible externally of said housing to allow for pluggable receipt of a selected circuit component therein.

3. The structure as recited in claim 1, and further including:

a third pair of metal strip electrical contacts within a corresponding third cavity of said housing, adapted for engagement on an electrical impedance component received in said third cavity, sixth and seventh and eighth pairs of metal strip switch poles, a first switch pole of each said sixth and said seventh pairs of poles being integral with one of said third pair of electrical contacts, a first switch pole of said eighth pair of poles being integral with the other of said third pair of electrical contacts, a second switch pole of said sixth pair of poles being integral with said first switch pole of said fifth pair of poles and thereby integral also with said corresponding one of said second electrical contacts, a second switch pole of each of said seventh and said eighth pairs of switch poles having an integral electrical terminal projecting outwardly of said housing for connection externally of said housing, each of said sixth and seventh and eighth pairs of switch poles having a corresponding manually operative switching means mounted at least partially within said housing and operatively making a disengageable electrical connection between corresponding first and second poles of said pairs of switch poles.

4. In a programmable circuit apparatus having a housing containing circuit paths interconnecting electrical switches, electrical leads and means for mounting electrical components in said housing, the improvement comprising:

said housing being molded of dielectric material, said switches being mounted respectively in first cavities and at least one second cavity provided in said dielectric material, said switches having knob portions projecting through a top surface of said housing, said means for mounting electrical components comprises inverted recesses in said dielectric material communicating with an inverted surface of said housing, and adapted to receive electrical impedances therein, said electrical leads being provided with first metal strip portions embedded in said dielectric material and communicating with corresponding said first cavities to engage said switches, said circuit paths having second metal strip portions embedded in said dielectric material and communicating with both said inverted recesses to engage said switches and said first cavities to engage said impedances, and each said second cavity having a corresponding pair of third metal strip portions of said circuit paths embedded in said dielectric material and connected to corresponding said second metal strip portions, whereby said switches in said first cavities selectively make disengageable connections between said first and second metal strip portions and each said switches in each said second cavity selectively makes disengageable connection between a corresponding pair of said third metal strip portions, and said electrical leads projecting outwardly of said housing for pluggable connection into a circuit board.

* * * * *